US011410823B2

(12) United States Patent
Liu et al.

(10) Patent No.: US 11,410,823 B2
(45) Date of Patent: Aug. 9, 2022

(54) VARIABLE FORCE KEY

(71) Applicant: DONGGUAN JINGYANG ELECTRONICS AND TECHNOLOGY CO., LTD., Guangdong (CN)

(72) Inventors: Lucy Liu, Guangdong (CN); Andong Li, Guangdong (CN)

(73) Assignee: DONGGUAN JINGYANG ELECTRONICS AND TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 17/325,847

(22) Filed: May 20, 2021

(65) Prior Publication Data

US 2021/0343487 A1 Nov. 4, 2021

Related U.S. Application Data

(63) Continuation-in-part of application No. PCT/CN2019/105038, filed on Sep. 10, 2019.

(30) Foreign Application Priority Data

Nov. 20, 2018 (CN) ..... 201811383946.5

(51) Int. Cl.
*H01H 13/14* (2006.01)
*H01H 13/10* (2006.01)
*H01H 13/52* (2006.01)

(52) U.S. Cl.
CPC ..... *H01H 13/14* (2013.01); *H01H 13/10* (2013.01); *H01H 13/52* (2013.01)

(58) Field of Classification Search
CPC ..... H01H 13/14; H01H 13/10; H01H 13/52; H01H 13/7065; H01H 13/85; H01H 3/28;
(Continued)

(56) References Cited

U.S. PATENT DOCUMENTS 4,117,430 A * 9/1978 Sims, Jr. ..... H01H 36/004 335/205
4,227,163 A * 10/1980 Barnoski ..... H03K 17/97 335/206
5,220,318 A * 6/1993 Staley ..... B41J 5/26 400/490

FOREIGN PATENT DOCUMENTS

CN 204242893 U 4/2015
CN 107785202 A 3/2018
(Continued)

OTHER PUBLICATIONS

International Search Report of International Application No. PCT/CN2019/105038 dated Dec. 13, 2019.
(Continued)

*Primary Examiner* — Lheiren Mae A Caroc
(74) *Attorney, Agent, or Firm* — IP & T Group LLP

(57) ABSTRACT

A variable force key, including a housing, a central shaft, and a magnetic ring, the central shaft extends into the housing, the top end of the center shaft is fixedly provided with a key cap seat, the central shaft can reciprocate in the housing in the vertical direction, the bottom end of the central shaft is fixedly provided with a limit member, the outer wall or inner wall of the bottom end of the limit member is provided with a flange, the magnetic ring sleeves the outer wall of the limit member or is arranged inside the limit member and located at the upper end of the flange. The variable force key further includes an electromagnet or a hollow coil, which is arranged at the bottom in the housing, and when the central shaft moves downward, the electromagnet or the hollow coil can penetrate inside the limit member.

12 Claims, 3 Drawing Sheets

(58) Field of Classification Search
CPC ..... H01H 9/56; H01H 2215/028; H01H 2215/05; H01H 13/705; H01H 36/00; H01H 36/004; H01H 36/0073; H01H 2036/0093; H01H 2221/04
See application file for complete search history.

(56) References Cited

FOREIGN PATENT DOCUMENTS

| | | | |
|---|---|---|---|
| CN | 110098078 | A | 8/2019 |
| JP | 11-339590 | A | 12/1999 |
| KR | 10-2007-0038745 | A | 4/2007 |

OTHER PUBLICATIONS

Written Opinion of The International Searching Authority of International Application No. PCT/CN2019/105038 dated Dec. 13, 2019.

* cited by examiner

VARIABLE FORCE KEY

CROSS-REFERENCE TO RELATED APPLICATIONS

This application is a continuation-in-part (CIP) application of PCT Application No. PCT/CN2019/105038, entitled "Variable Force Key", and the PCT Application No. PCT/CN2019/105038 claims the priority to the Chinese patent application with the filing number CN 201811383946.5, filed on Nov. 20, 2018 with the Chinese Patent Office, and entitled "Variable Force Key", the contents of which are incorporated herein by reference in entirety.

TECHNICAL FIELD

The present disclosure relates to the field of keyboard accessories, in particular to a variable force key.

BACKGROUND ART

The keyboard is the most commonly used and most important input device for the computer. English letters, numbers, punctuation marks and the like can be input into the computer by tapping the keyboard, so as to send commands and input data to the computer, etc. The keyboards are divided into mechanical keyboards, membrane keyboards, conductive silicone keyboards, and capacitive keyboards. Among them, the mechanical keyboard has a strong sense of rhythm and will not change hand feeling after long-term use, which is deeply loved by game players.

At present, the tactile feel and pressure of mechanical keyboard mainly depend on the use of different shafts to change the tactile feel, such as the four commonly used shafts of black, red, green, and brown in the market. The black shaft has the strongest tactile feel; the red shaft basically has no tactile feel; the green shaft has a relatively small tactile feel, but the clicky feel is obvious, with obvious rhythmic sound; the tactile feel of the brown shaft is similar to that of the green shaft, but the clicky feel is not strong. If users want to feel different hand feelings, users must purchase mechanical keyboards with different color shafts. If users don't know their preferences, it is easy to buy a mechanical keyboard that is not suitable for themselves, which will cause users to repeat purchases and waste costs. Similarly, users cannot define the tactile feel and force of the mechanical shaft according to their own preferences.

In order to solve the above problems, the applicant has disclosed a magnetic key (Publication No. CN107785202A), which includes a housing and a central shaft body arranged in the housing. The top of the central shaft body is provided with a key cap seat, and the bottom of the central shaft body extends into the housing, and after pressing the key cap seat, the central shaft body can reciprocate in the vertical direction in the base, which is characterized in that: the central shaft body is provided with a baffle that divides the central shaft body into two sections, the upper section of the central shaft body is provided with a first magnetic element, and a second magnetic element that can move up and down is provided under the same shaft of the first magnetic element. A return spring is provided in the lower section of the central shaft body, a third magnetic element is provided in the housing, the third magnetic element is an energized coil whose magnitude of energization current can be adjusted.

Since the first magnetic element is fixed on the upper section of the central shaft body, and the second magnetic element is a permanent magnetic element, in the initial state, the second magnetic element is attracted and attached to the first magnetic element by the action of magnetic force. When the key is pressed down to trigger the conduction of the energized coil, the third magnetic element gives the second magnetic element a repulsive force opposite to the pressing direction of the key by controlling the current, and then changes the energized direction of current, the magnetic force is generated between the second magnetic element and the third magnetic element and is greater than that between the first magnetic element and the second magnetic element, the second magnetic element moves along the central shaft body to the bottom and impacts the baffle provided on the central shaft body, so as to generate a pressing tactile feel.

In actual operation, it is found that since the second magnetic element is attracted and attached to the first magnetic element, the distance between the second magnetic element and the third magnetic element is very far, so the repulsive force of the third magnetic element to the second magnetic element is actually very small. At the same time, due to the use of coils, the generated magnetic field is relatively weak, so the tactile feel generated is not strong, which reduces the user's sense of experience. It is necessary to increase the current by several or tens of times to the third magnetic element for increasing the tactile feel, which is inconvenient to use; in addition, since the magnet and spring pass through the center of the coil, the coil cannot increase the iron core to enhance its efficiency.

SUMMARY

In order to solve the above problems, the present disclosure provides a variable force key, which can realize a variety of variable force methods, greatly improve the tactile feel of the key, and improve the user's sense of experience. At the same time, by making a slight change to the current, the intensity of the tactile feel of the key can be obviously changed.

In order to achieve the above objective, the technical solution adopted by the present disclosure is: a variable force key, comprising a housing, central shaft, and a magnetic ring, wherein the central shaft extends into the housing, the top end of the center shaft is fixedly provided with a key cap seat, a return spring is arranged between the bottom end of the central shaft and an inner bottom surface of the housing, the central shaft can reciprocate in the housing in the vertical direction, the bottom end of the central shaft is further fixedly provided with a limit member, the outer wall of the bottom end of the limit member is provided with a flange in a circumferential direction, the magnetic ring is sleeved on the outer wall of the limit member and located at the upper end of the flange, and the magnetic ring is a permanent magnet magnetized along the axial direction of the limit member, wherein the variable force key further includes an electromagnet or a hollow coil, the electromagnet or the hollow coil is arranged at the bottom in the housing, and when the central shaft moves downward, the electromagnet or the hollow coil can penetrate inside the limit member, and the magnitude and the direction of current of the electromagnet or the hollow coil can both be adjusted.

Specifically, the bottom end of the housing is fixedly provided with a control circuit board for applying a control current to the electromagnet or the hollow coil, the control circuit board is provided with a trigger component for triggering control of the control circuit board, and the trigger component generates a trigger signal through the downward movement of the central shaft, the trigger component is connected to the input end of the control circuit board, the control output end of the control circuit board is connected to the electromagnet or the hollow coil.

Specifically, the bottom end of the housing is provided with a through hole corresponding to the electromagnet or the hollow coil, and the electromagnet or the hollow coil passes through the through hole and is connected to the control circuit board.

Specifically, the inner side surface of the housing is provided with a sliding groove along the vertical direction, the central shaft is provided with a sliding block corresponding to the sliding groove, and the sliding block is slidably connected with the sliding groove.

Specifically, the limit member is a number of arc blocks arranged in a form of a circumferential array.

Specifically, the bottom end of central shaft is provided with a guide post, the bottom end of the housing is provided with a guide sleeve corresponding to the guide post, the guide post is inserted into the guide sleeve, and the return spring is sleeved on the surface of the guide post.

Specifically, the housing includes a base and an upper cover, the outer side surface of the base is provided with a clamping block, the side surface of the upper cover is provided with a clamping slot corresponding to the clamping block, and the clamping block is clamped in the clamping slot, then the upper cover is fixedly connected to the base.

Specifically, the bottom end of the central shaft is provided with a magnet, and the magnetic ring is magnetically attached to the magnet.

In order to achieve the above object, the present disclosure also provides a variable force key, which includes a housing, central shaft, and a magnetic ring, wherein the central shaft extends into the housing, the top end of the center shaft is fixedly provided with a key cap seat, a return spring is arranged between the bottom end of the central shaft and an inner bottom surface of the housing, the central shaft can reciprocate in the housing in the vertical direction, the bottom end of the central shaft is further fixedly provided with a limit member, the inner wall of the bottom end of the limit member is provided with a flange in a circumferential direction, the magnetic ring is arranged inside the limit member and located at the upper end of the flange, and the magnetic ring is a permanent magnet magnetized along the axial direction of the limit member, wherein the variable force key further includes an electromagnet or a hollow coil, the electromagnet or the hollow coil is arranged at the bottom in the housing, and when the central shaft moves downward, the electromagnet or the hollow coil can penetrate inside the limit member, and the direction and magnitude of current of the electromagnet or the hollow coil can both be adjusted.

The beneficial effects of the present disclosure are as follows:

in some embodiments, the present disclosure adopts electromagnets. Since the magnetic permeability of the iron core of the electromagnet 4 is far greater than that of air, the magnetic permeability of air is about 1, and the magnetic permeability of the iron core used by the electromagnet can reach several thousand. The size of the magnetic field generated by the coil of the electromagnet is proportional to the magnetic permeability of the coil magnetic field loop, so that a large magnetic force can be generated under the action of a small current, and the energy conversion rate is very high, thus, the repulsive force and attraction force acting on the magnet are also increased, which can effectively generate upward thrust and downward tension, and thus greatly improve the user's tactile feel intensity.

In some embodiments, the present disclosure adopts the hollow coil to replace the electromagnet. As the hollow coil has a relatively small inductance value, after energization, the hollow coil can be charged in a short period of time to reach a current maximum value, and thus when a pressure is applied to the key cap seat to turn on the hollow coil, the hollow coil can generate an instantaneous repulsive force to the magnetic ring 3 in a short period of time. Therefore, the response is extremely fast after the user presses the key, and the user does not feel any hysteresis of hand feeling at all, thereby increasing the user experience.

Besides, since the magnetic ring is sleeved or arranged inside the limit member, when the key cap seat is pressed down and moved downward, the electromagnet or the hollow coil can penetrate the inside of the limit member, so that the distance between the electromagnet and the magnetic ring or the distance between the hollow coil and the magnetic ring can be overlapped or far away, so that a variety of variable force control methods can be realized.

In a natural state, the magnetic ring moves down along the limit member due to gravity action and then attaches on the flange at the bottom end of the limit member. When a pressure is applied to the key cap seat, the central shaft drives the limit member to move downward, after the electromagnet or the hollow coil is forwardly electrified, the electromagnet or the hollow coil generates a repulsive force on the magnetic ring, causing the magnetic ring to move upward along the limit member to impact the central shaft, thereby generating an upward thrust to the central shaft; after the electromagnet or the hollow coil is reversely electrified, the electromagnet or the hollow coil generates a magnetic force on the magnetic ring, making the magnetic ring move down rapidly to impact the flange of the limit member to produce a tactile feel. Since the thrust is generated by the impact of the magnetic ring, the tactile feel will be very obvious, which increases the user's sense of experience, and the electromagnet or the hollow coil can penetrate the inside of the limit member, so that the spacing between the magnetic ring and the electromagnet or the spacing between the magnetic ring and the hollow coil is very small. A slight change in the current of electromagnet or hollow coil can significantly change the intensity of the tactile feel of the key.

Figure 1:
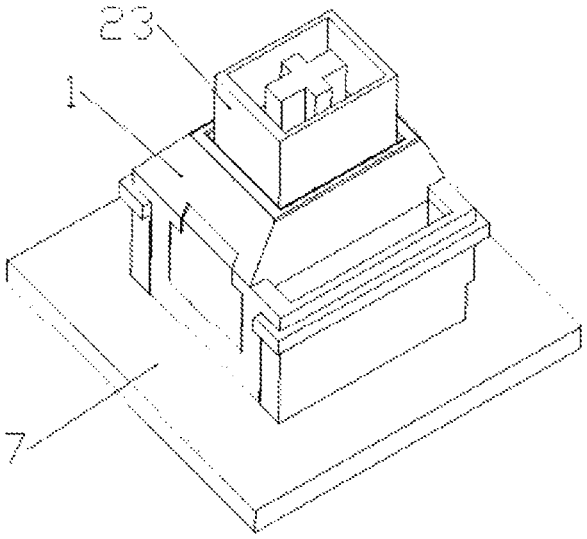
FIG. 1 is an overall structural schematic view of embodiment 1 in the present disclosure.
Figure 2:
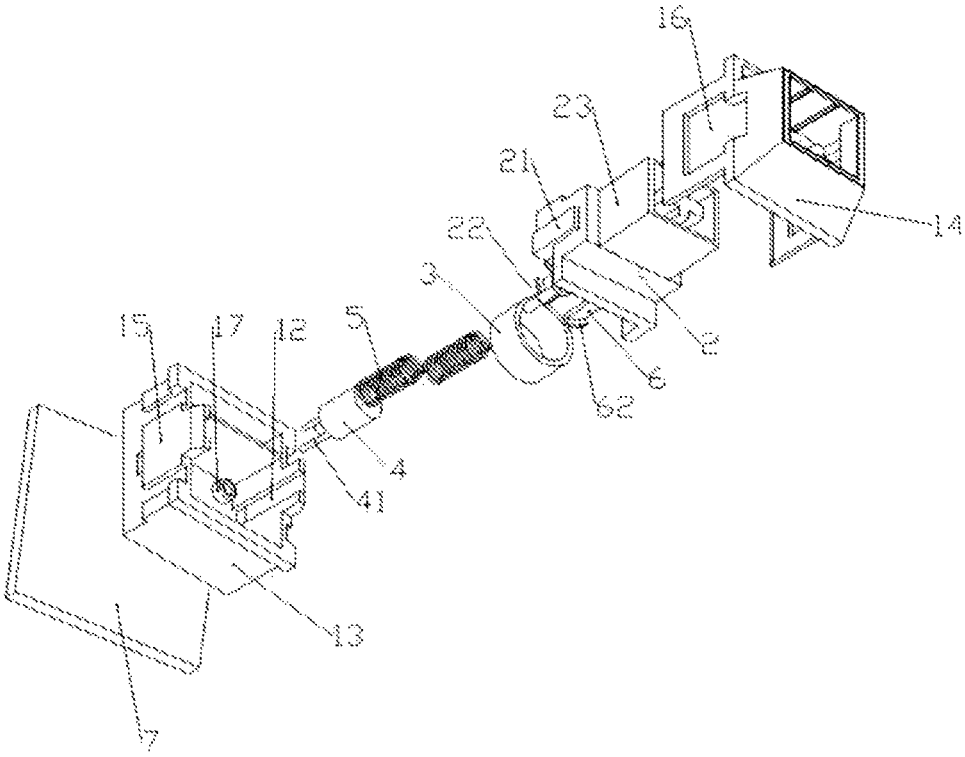
FIG. 2 is an exploded view of parts of embodiment 1 in the present disclosure.
Figure 3:
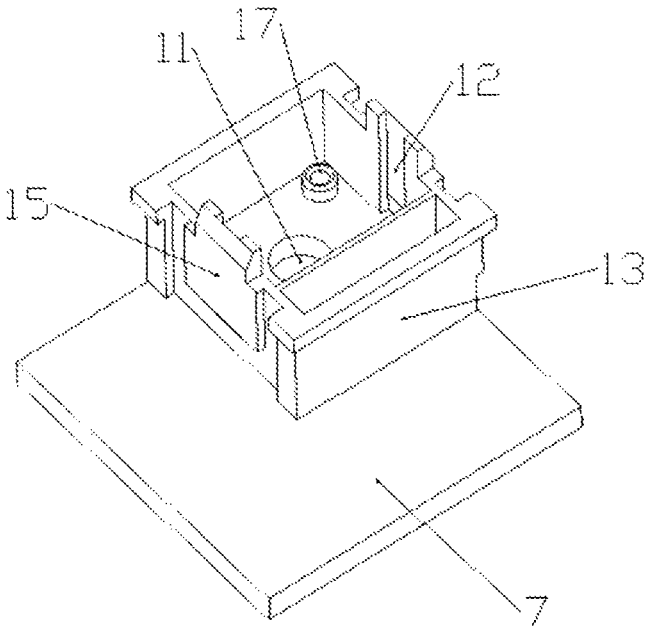
FIG. 3 is a structural schematic view of the base of embodiment 1 in the present disclosure.
Figure 4:
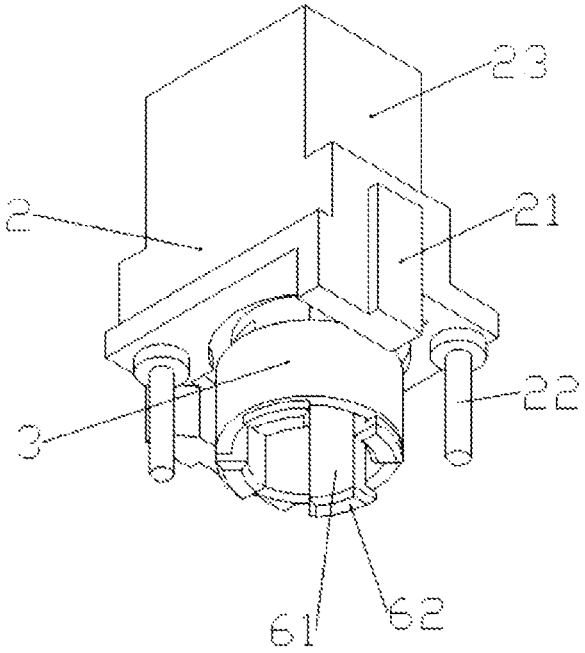
FIG. 4 is a structural schematic view of the central shaft of embodiment 1 in the present disclosure.

Reference Signs: 1—housing; 2—central shaft; 3—magnetic ring; 4—electromagnet; 5—return spring; 6—limit member; 7—control circuit board; 11—through hole; 12—sliding groove; 13—base; 14—upper cover; 15—clamping block; 16—clamping slot; 17—guide sleeve; 21—sliding block; 22—guide post; 23—key cap seat; 41—weld leg; 61—arc block; 62—flange.

DETAILED DESCRIPTION OF EMBODIMENTS

Embodiment 1

Please refer to FIG. 1-FIG. 4, the present disclosure relates to a variable force key, which includes a housing 1, central shaft 2, a magnetic ring 3 and an electromagnet 4, wherein the central shaft 2 extends into the housing 1, the top end of the center shaft 2 is fixedly provided with a key cap seat 23, a return spring 5 is arranged between the bottom end of the central shaft 2 and an inner bottom surface of the housing 1, the central shaft 2 can move back and forth in the housing 1 in the vertical direction, the bottom end of the central shaft 2 is further fixedly provided with a limit member 6, the limit member 6 can be arranged as a hollow cylinder, and the outer wall of the bottom end of the limit member 6 is provided with a flange 62 along the circumferential direction. The magnetic ring 3 is sleeved on the outer wall of the limit member 6 and located at the upper end of the flange 62, and the magnetic ring 3 is a permanent magnet magnetized along the axial direction of the limit member 6, the electromagnet 4 is arranged at the bottom in the housing 1, and when the central shaft 2 moves downward, the electromagnet 4 can penetrate into the inside the limit member 6, and the magnitude and direction of current of the electromagnet 4 can both be adjusted.

Since the magnetic ring is sleeved or arranged inside the limit member, when the key cap seat is pressed down and moved downward, the electromagnet can penetrate inside the limit member, so that the distance between the electromagnet and the magnetic ring can be overlapped or far away, thereby a variety of variable force control methods can be realized.

Several control methods are described below.

(1) In a natural state, the magnetic ring 3 moves down along the limit member 6 due to gravity action and then attaches on the flange 62 at the bottom end of the limit member 6, so that the distance between the magnetic ring 3 and the electromagnet 4 is reduced.

When a pressure is applied to the key cap seat 23, the central shaft 2 drives the limit member 6 to move downwards. After the electromagnet 4 is forwardly electrified, the electromagnet 4 generates a repulsive force on the magnetic ring 3, causing the magnetic ring 3 to move upward along the limit member 6 and impact the central shaft 2, thereby generating an upward thrust to the central shaft 2. After the electromagnet 4 is reversely electrified, the electromagnet 4 generates a magnetic force on the magnetic ring 3, causing the magnetic ring 3 to move down rapidly and impact the flange 62 of the limit member 6 to produce a tactile feel. Since both thrust and repulsive force are generated by the impact of the magnetic ring 3, the tactile feel is very obvious, which increases the user's sense of experience.

(2) In the natural state, a small current to the electromagnet 4 is applied to generate a repulsive force on the magnetic ring 3, so that the magnetic ring 3 is kept at the bottom of the central shaft 2. When a pressure is applied to the key cap seat 23, the limit member 6 is moved downwards along with the central shaft 2, and the current of repulsive force for the electromagnet 4 is increased. The electromagnet 4 generates an abruptly altered repulsive force on the magnetic ring 3, causing the magnetic ring 3 to push the central shaft 2 upward to generate a thrust, and then a reverse current is applied to the electromagnet to make the electromagnet 4 and the magnetic ring 3 attract each other, so that the magnetic ring 3 moves down rapidly and impacts the flange 62 to produce a downward tactile feel. Changing the magnitude of the current in each stage can control the force of each stage, to achieve different hand feelings.

(3) The electromagnet 4 is designed in a pancake shape, and the magnetic ring can move, along with the central shaft 2, from the top of the electromagnet 4 to the bottom of the electromagnet 4. By default, a reverse current is applied to the electromagnet 4 to make the electromagnet 4 and the magnetic ring 2 generate a repulsive force. When a pressure is applied to the key cap seat 23, the central shaft 2 drives the magnetic ring 3 to move downwards. When the magnetic ring 3 is close to electromagnet 4, the upward thrust is increased, until the center of magnetic ring 3 coincides with the center of electromagnet 4, the repulsive force disappears. When the central shaft 2 pushes the magnetic ring 3 to continue to move downwards, the magnetic ring 3 is driven by the downward repulsive force of the electromagnet 4, and then the magnetic ring 3 is moved downward rapidly to produce a tactile feel. The control method and control circuit in this way are relatively simple.

Since the magnetic permeability of the iron core of the electromagnet 4 is much greater than that of air, the magnetic permeability of air is about 1, and the magnetic permeability of the iron core used in the electromagnet can reach several thousand, and the size of the magnetic field generated by the coil of the electromagnet is proportional to the magnetic permeability of the coil magnetic field loop, so that a large magnetic force can be generated under the action of a small current, and the energy conversion rate is very high, thus, the repulsive force and attraction force acting on the magnet are also increased, which can effectively generate upward thrust and downward tension, and greatly improve the user's tactile feel intensity.

When the central shaft 2 moves down, it will transmit a trigger signal to the control circuit board 7 through the trigger component, so that the control circuit board 7 applies a forward or reverse control current to the electromagnet 4, so that the electromagnet 4 generates a magnetic force or a repulsive force on the magnetic ring 3.

In this embodiment, the bottom end of the housing 1 is provided with a through hole 11 corresponding to the electromagnet 4, and the electromagnet 4 passes the through hole 11 and is connected to the control circuit board 7.

By designing a through hole 11 at the bottom end of the housing 1, the electromagnet 4 can directly pass through the through hole 11, which is convenient for welding the weld leg 41 of the electromagnet 4 with the control circuit board 7. Compared with the conventional butt joint manner of designing the spring piece and the weld leg 41 on the housing 1, the connection method of this embodiment is more convenient and firmer.

In this embodiment, the inner side surface of the housing 1 is provided with a sliding groove 12 along the vertical direction, the central shaft 2 is provided with a sliding block 21 corresponding to the sliding groove 12, and the sliding block 21 is slidably connected with the sliding groove 12.

The sliding fit of the sliding block 21 and the sliding groove 12 provides a guiding effect for the movement of the central shaft 2, and makes the movement of the central shaft 2 more stable and accurate.

In this embodiment, the limit member 6 is a plurality of arc blocks 61 arranged in a form of a circumferential array.

The limit member 6 is formed by a plurality of arc blocks 61 arranged at intervals in the circumferential direction, which can save the material of the limit member 6 and also reduce the weight of the key cap seat 23.

In this embodiment, the bottom end of the central shaft 2 is provided with a guide post 22, the bottom end of the housing 1 is provided with a guide sleeve 17 corresponding to the guide post 22, the guide post 22 is inserted into the guide sleeve 17, and the return spring 5 is sleeved on the surface of the guide post 22.

The guide post 22 moves along the guide sleeve 17, then it is ensured that the elastic action of the return spring 5 is in the vertical direction, so that the restoration of the central shaft 2 is stable and accurate.

In this embodiment, the housing 1 includes a base 13 and an upper cover 14, the outer side surface of the base 13 is provided with a clamping block 15, and the side surface of the upper cover 14 is provided with a clamping slot 16 corresponding to the clamping block 15, the upper cover 14 is fixedly connected to the base 13 by the clamping block 15 being clamped in the clamping slot 16.

The detachable connection between the upper cover 14 and the base 13 is realized by the clamping between the clamping block 15 and the clamping slot 16, which is convenient for the parts to be repaired and replaced.

In this embodiment, the bottom end of the central shaft 2 is provided with a magnet, and the magnetic ring 3 is magnetically attached to the magnet. In the natural state, the magnetic ring 3 is held at the bottom of the central shaft 2 due to the magnet attraction force at the bottom of the central shaft 2, when a pressure is applied to the key cap seat 23, central shaft 2 drives the limit member 7 to move downward, after the electromagnet 4 is forwardly electrified, the electromagnet 4 generates a repulsive force on the magnetic ring 3, so that the magnetic ring 3 pushes the central shaft 2 upward to generate a thrust, and then a reverse current is applied to the electromagnet 4 to make the magnetic ring 3 and the electromagnet 4 attract each other, so that the magnetic ring 3 moves down rapidly and impacts the flange 62 to produce a downward tactile feel.

Embodiment 2

Figure 5:
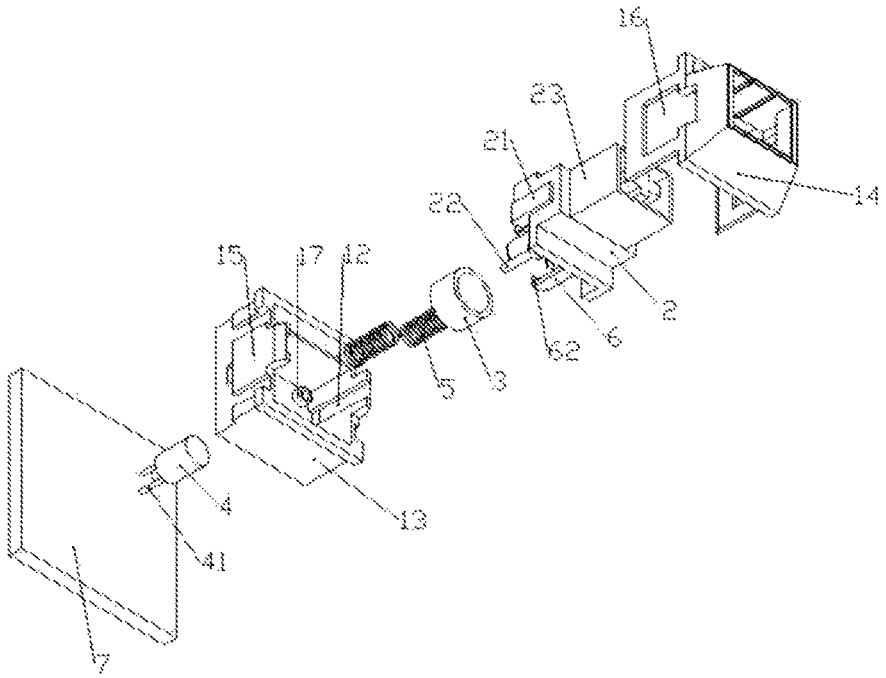
FIG. 5 is an exploded view of parts of embodiment 2 in the present disclosure.
Figure 6:
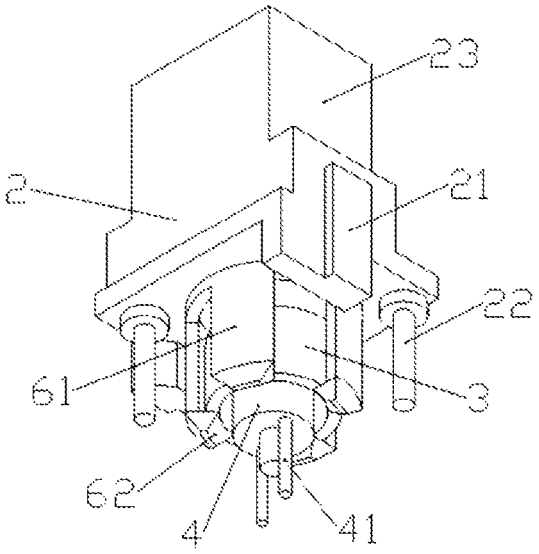
FIG. 6 is a central shaft structural schematic view of embodiment 2 in the present disclosure.

Please refer to FIG. 5-FIG. 6, in order to achieve the above-mentioned object, the present disclosure also provides a variable force key, which includes a housing 1, a central shaft 2, a magnetic ring 3 and an electromagnet 4, wherein the central shaft 2 extends into the housing 1, the top end of the center shaft 2 is fixedly provided with a key cap seat 23, a return spring 5 is arranged between the bottom end of the central shaft 2 and an inner bottom surface of the housing 1, the central shaft 2 can move back and forth in the housing 1 in the vertical direction, the bottom end of the central shaft 2 is further fixedly provided with a limit member 6, the limit member 6 can be arranged as a hollow cylinder, and the inner wall of the bottom end of the limit member 6 is provided with a flange 62 along the circumferential direction. The magnetic ring 3 is arranged inside the limit member 6 and located at the upper end of the flange 62, and the magnetic ring 3 is a permanent magnet magnetized along the axial direction of the limit member 6, the electromagnet 4 is arranged at the bottom in the housing 1, and when the central shaft 2 moves downward, the electromagnet 4 can penetrate inside the limit member 6, and the magnitude and direction of current of the electromagnet 4 can both be adjusted.

The variable force keys described above are merely exemplary, and the above embodiments may be modified without departing from the present disclosure. Next, a modified embodiment will be described below. For the sake of brevity, the same parts in the modified embodiment as in the preceding Embodiment 1 and Embodiment 2 will not be redundantly described.

In some embodiments, a hollow coil may be used to replace the electromagnet 4 described in the preceding Embodiment 1 and Embodiment 2. In other words, the variable force key provided in the present disclosure may not include the electromagnet 4 described in the preceding, but alternatively include a hollow coil. Similar to the electromagnet 4, the hollow coil can generate a magnetic field when being energized, thus the hollow coil may be provided in a manner completely the same as that of providing the electromagnet 4 in the preceding Embodiment 1 and Embodiment 2, and the variable force key including the hollow coil can be controlled in a method completely the same as the three control methods specifically described in the preceding Embodiment 1.

It should be noted that the relative magnetic permeability μs of the hollow coil is 1, and the relative magnetic permeability of the iron core used by the electromagnet may reach several thousand, therefore, it can be determined, according to the following formula 1, that the inductance value of the hollow coil in the present embodiment is far smaller than that of the electromagnet.

$$L=(k*\mu 0*\mu s*N^2*S)/l \quad \text{(formula 1)}$$

In the above, L is the inductance value; μ0 is magnetic permeability in vacuum, $4\pi*10^{-7}$; μs is the relative magnetic permeability of a magnetic core inside the coil; $N^2$ is square of coil turns; S is cross sectional area of the coil, in unit of square meter; l is length of the coil, in unit of meter; and k is a coefficient, depending upon a ratio of radius R to length l of the coil.

Besides, it further may be determined, according to the following formula 2, that charging and discharging time of an inductor increases along with the increase of the inductance value.

$$\tau=L/R \quad \text{(formula 2)}$$

In the above, τ is charging and discharging time of the inductor; L is the inductance value; and R is the radius of the coil.

As the present embodiment adopts the hollow coil with a relatively small inductance value, after energization, the hollow coil can be charged in a short period of time to reach a current maximum value, and thus when a pressure is applied to the key cap seat 23 to turn on the hollow coil, the hollow coil can generate an instantaneous repulsive force to the magnetic ring 3 in a short period of time. Therefore, the response is extremely fast after the user presses the key, and the user does not feel any hysteresis of hand feeling at all, thereby increasing the user experience.

The above embodiments are only a description of the preferred embodiments of the present disclosure, and are not intended to limit the scope of the present disclosure. Without departing from the design spirit of the present disclosure, various modifications and changes made by those ordinarily skilled in the art to the technical solutions of the present disclosure, should fall within the protection scope determined by the claims of the present disclosure.

What is claimed is:

1. A variable force key, comprising a housing, a central shaft, and a magnetic ring, wherein the central shaft extends into the housing, a top end of the center shaft is fixedly provided with a key cap seat, a return spring is arranged between a bottom end of the central shaft and an inner bottom surface of the housing, the central shaft is able to reciprocate in the housing in a vertical direction, the bottom end of the central shaft is further fixedly provided with a limit member, an outer wall of a bottom end of the limit member is provided with a flange in a circumferential direction, the magnetic ring is sleeved on an outer wall of the limit member and located at an upper end of the flange, or an inner wall of the bottom end of the limit member is provided with a flange in the circumferential direction, and the magnetic ring is arranged inside the limit member and located at the upper end of the flange, and the magnetic ring is a permanent magnet magnetized along an axial direction of the limit member, wherein the variable force key further comprises an electromagnet or a hollow coil, the electromagnet or the hollow coil is arranged at a bottom in the housing, and when the central shaft is moved downward, the electromagnet or the hollow coil is able to penetrate inside the limit member, and both a magnitude and a direction of current of the electromagnet or the hollow coil are able to be adjusted.

2. The variable force key according to claim 1, wherein a bottom end of the housing is fixedly provided with a control circuit board configured to apply a control current to the electromagnet or the hollow coil, and a control output end of the control circuit board is connected to the electromagnet or the hollow coil.

3. The variable force key according to claim 2, wherein the bottom end of the housing is provided with a through hole corresponding to the electromagnet or the hollow coil, and the electromagnet or the hollow coil passes through the through hole and is connected to the control circuit board.

4. The variable force key according to claim 3, wherein the housing comprises a base and an upper cover, wherein an outer side surface of the base is provided with a clamping block, a side surface of the upper cover is provided with a clamping slot corresponding to the clamping block, the clamping block is clamped in the clamping slot, and then the upper cover is fixedly connected to the base.

5. The variable force key according to claim 2, wherein the housing comprises a base and an upper cover, wherein an outer side surface of the base is provided with a clamping block, a side surface of the upper cover is provided with a clamping slot corresponding to the clamping block, the clamping block is clamped in the clamping slot, and then the upper cover is fixedly connected to the base.

6. The variable force key according to claim 1, wherein an inner side surface of the housing is provided with a sliding groove in a vertical direction, the central shaft is provided with a sliding block corresponding to the sliding groove, and the sliding block is slidably connected with the sliding groove.

7. The variable force key according to claim 6, wherein the housing comprises a base and an upper cover, wherein an outer side surface of the base is provided with a clamping block, a side surface of the upper cover is provided with a clamping slot corresponding to the clamping block, the clamping block is clamped in the clamping slot, and then the upper cover is fixedly connected to the base.

8. The variable force key according to claim 1, wherein the limit member is a number of arc blocks arranged in a form of a circumferential array.

9. The variable force key according to claim 8, wherein the housing comprises a base and an upper cover, wherein an outer side surface of the base is provided with a clamping block, a side surface of the upper cover is provided with a clamping slot corresponding to the clamping block, the clamping block is clamped in the clamping slot, and then the upper cover is fixedly connected to the base.

10. The variable force key according to claim 1, wherein the bottom end of central shaft is provided with a guide post, a bottom end of the housing is provided with a guide sleeve corresponding to the guide post, the guide post is inserted into the guide sleeve, and the return spring is sleeved on a surface of the guide post.

11. The variable force key according to claim 10, wherein the housing comprises a base and an upper cover, wherein an outer side surface of the base is provided with a clamping block, a side surface of the upper cover is provided with a clamping slot corresponding to the clamping block, the clamping block is clamped in the clamping slot, and then the upper cover is fixedly connected to the base.

12. The variable force key according to claim 1, wherein the housing comprises a base and an upper cover, wherein an outer side surface of the base is provided with a clamping block, a side surface of the upper cover is provided with a clamping slot corresponding to the clamping block, the clamping block is clamped in the clamping slot, and then the upper cover is fixedly connected to the base.

* * * * *